United States Patent [19]

Berkovits

[11] Patent Number: 4,655,867

[45] Date of Patent: Apr. 7, 1987

[54] METHOD FOR AFFIXING NON-SLIP STRIPS TO GARMENT HANGERS

[76] Inventor: Abraham H. Berkovits, 4824 N. Berkley Blvd., Milwaukee, Wis. 53217

[21] Appl. No.: 730,847

[22] Filed: May 6, 1985

[51] Int. Cl.[4] ..... B44C 1/16; B32B 31/00

[52] U.S. Cl. ..... 156/234; 156/239; 156/249; 156/344; 223/DIG. 2

[58] Field of Search ..... 156/230, 234, 238, 249, 156/344, 247, 573, 254, 559; 223/85, 87, 92, 98, 95, DIG. 2

[56] References Cited

U.S. PATENT DOCUMENTS

| | | | |
|---|---|---|---|
| 1,910,901 | 5/1933 | Koplow | 223/92 |
| 3,094,451 | 6/1963 | Wagner | 156/249 |
| 3,334,736 | 8/1967 | Cole et al. | 223/85 |
| 3,997,091 | 12/1976 | Burnette | 223/87 |
| 4,113,538 | 9/1978 | Green | 156/249 |
| 4,113,906 | 9/1978 | Brandwein | 156/249 |
| 4,173,510 | 11/1979 | Tobey | 156/584 |
| 4,177,104 | 12/1979 | Parker | 156/584 |
| 4,216,048 | 8/1980 | Gehweiler | 156/344 |
| 4,285,759 | 8/1981 | Allen et al. | 156/584 |
| 4,466,849 | 8/1984 | Dantsker | 156/344 |

FOREIGN PATENT DOCUMENTS 526850 9/1940 United Kingdom .

*Primary Examiner*—Donald Czaja
*Assistant Examiner*—Louis Falasco
*Attorney, Agent, or Firm*—Joseph S. Heino

[57] ABSTRACT

Non-slip strips are affixed to the shoulder members of garment hangers by supporting a row of resilient, adhesive-backed, non-slip strips removably adhered to a backing with a holder and by engagably drawing a guided garment hanger shoulder member along one such strip. The strip is thereby simultaneously removed from the backing and affixed to the garment hanger to assist in the retention of garments hanging thereon.

7 Claims, 6 Drawing Figures

METHOD FOR AFFIXING NON-SLIP STRIPS TO GARMENT HANGERS

SUMMARY OF THE INVENTION

This invention relates to methods for applying and removing pressure-adhesive materials to and from objects. More particularly, it relates to a method for the simultaneous removal of adhesive-backed, non-slip strips from a backing and application of said strips to the shoulders of garment hangers which strips facilitate retention of garments hanging thereon.

In his many years of experience in the art with which the invention is concerned, the inventor has obtained no knowledge of any prior art which is pertinent to the essential features or special utility for usage of the present invention.

Currently, when a garment wholesaler or retailer desires to affix non-slip strips to garment hangers, such strips must be removed from a paper backing to which they are removably adhered and applied to garment hangers entirely by hand. It is, therefore, a principal object of the present invention to provide a method of removal and application of such strips which results in a significant reduction of the time and effort presently involved. It is another object of the present invention to provide such a method which accomplishes the strip removing and affixing steps simultaneously. It is still another object of the present invention to provide such a method without involving complex and costly equipment and materials and which makes such a method economically feasible for virtually all garment wholesalers and retailers.

The method of the present invention has obtained these objects. It provides for a presegmented strip of adhesive-backed, non-slip material, such as sponge rubber, so situated on a holder and guide apparatus that when the shoulder member of a garment hanger is drawn across one of said strips, the strip is simultaneously separated from the paper backing and affixed to the shoulder member of said garment hanger. The foregoing and other features of the method of the present invention will be further apparent from the description which follows.

DETAILED DESCRIPTION

Figure 3:
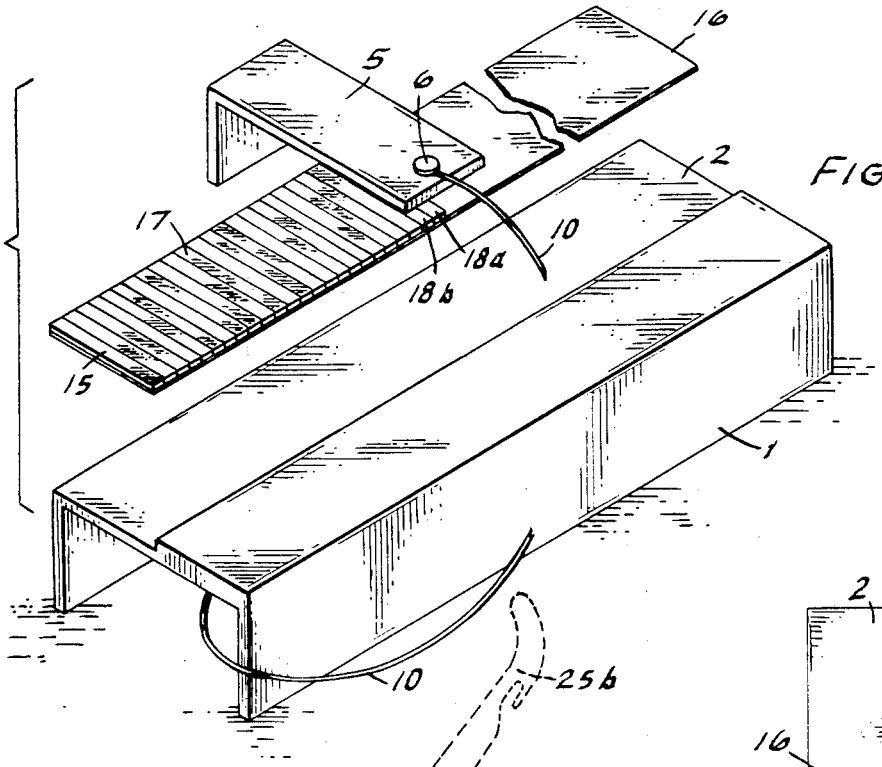
FIG. 3 is an exploded perspective view of the apparatus used for attaching non-slip strips to garment hangers.
Figure 4:
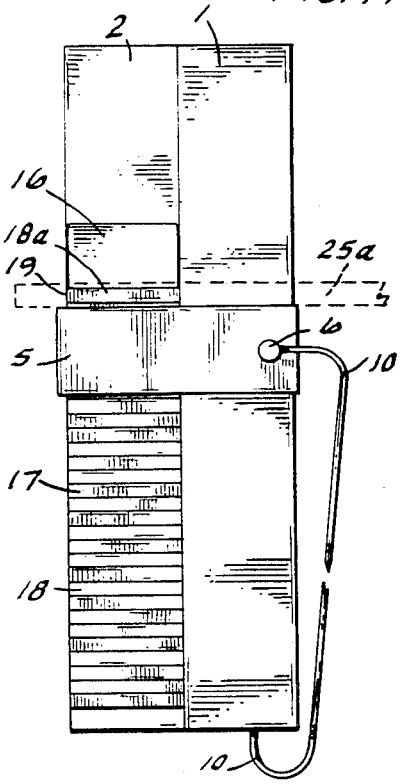
FIG. 4 is a plan view of the same apparatus showing the garment hanger in phantom position ready to be affixed with a non-slip strip.

Reference is now made more particularly to the drawings and particularly to FIG. 3 which shows an apparatus used to carry out the method of the present invention for attaching non-slip strips to garment hangers. As shown, the apparatus comprises a holder 1 and complimentary guide member 5, said guide member 5 being longitudinally adjustable along said holder 1. The top surface of the holder 1 is provided with a longitudinally-extending channel 2 located on the side of said holder 1 opposite the user for receiving a strip element generally identified 15.

Figure 2:
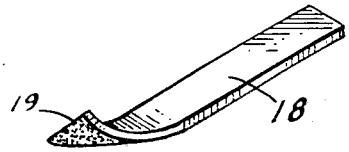
FIG. 2 is a perspective view of a non-slip strip.

The strip element 15 is comprised of a layer of adhesive-backed, non-slip material 17 removably adhered to a paper backing 16. It has been found advantageous to utilize a material such as sponge rubber for this layer 17 and to provide such layer 17 with a textured top surface and smooth bottom surface, said bottom surface being that which is adhesive-coated and faces the paper backing 16. The layer 17 is transversely segmented to form a plurality of strips 18. The width of each strip 18 corresponds to the thickness of a garment hanger 25, typically 3/16 to ⅜ in. (5 to 10 mm.) and is typically 2 in. (5 cm.) in length for optimum non-slip action. See FIG. 2. The layer 17 illustrated herein may be further segmented longitudinally so that the strip element 15 may be folded in half longitudinally with the paper backing 16 to the inside of the fold. Accordingly, a strip-receiving channel 2 is provided having a depth and width that corresponds substantially to the thickness and width of an unfolded or folded strip element 15, depending upon which type of strip element 15 said channel 2 is designed to receive.

As a practical matter, a channel 2 having a depth only slightly greater than the thickness of an unfolded strip element 15, said non-slip typically 1/16 in. (1.5 mm.) thick and layer 17 being quite resilient, is capable of accommodating either an unfolded or folded strip element 15. Such a depth is optimum for the additional reason that once all of the strips 18 have been removed from one side of a folded strip element 15, said strip element 15 is inverted in the channel 2 and the element 15 becomes, in effect, an unfolded strip element 15, the paper backing 16 being of negligible thickness.

Figure 5:
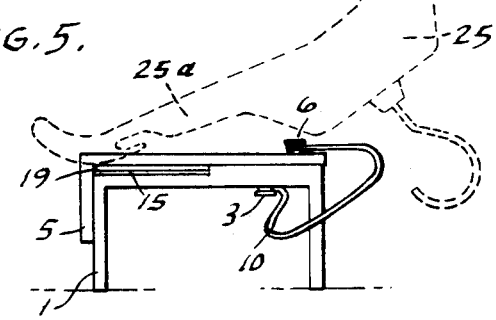
FIG. 5 is a close-up fragmentary side elevation view showing a strip being affixed to a garment hanger.

The guide member 5 and holder 1 are connected by a cord 10. One end of the cord 10 is attached to the top surface of the guide member 5 by a securing means 6. The other end of said cord 10 is attached to the underside of the holder 1 by a second securing means 3. The securing means 3, 6 may consist of a hold-down pin, as illustrated in FIG. 5, or of an adhesive-backed, non-slip strip 18 secured over each end of said cord 10.

In the attachment of non-slip strips 18 to garment hangers 25 according to the teaching of the present invention, the strip element 15 is positioned in the holder channel 2 with the non-slip material layer 17 facing up. The guide member 5 is then positioned over said holder 1 and strip element 15 and so aligned that it overlays the strips 18 and exposes a foremost non-slip strip **18*a* to either side of said guide member 5**, depending on the orientation desired or required by the user.

Figure 1:
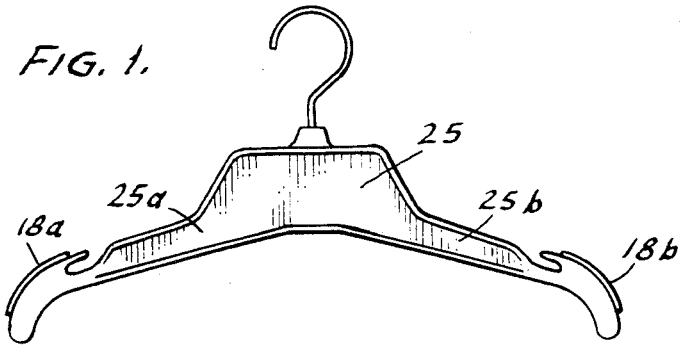
FIG. 1 is a side elevation view of a garment hanger shown with non-slip strips affixed thereto.
Figure 6:
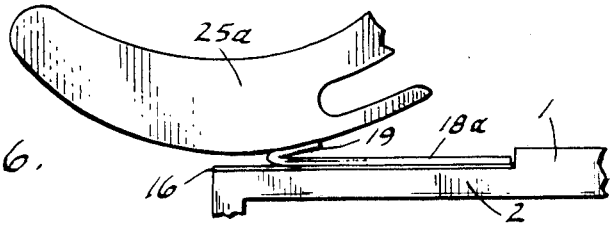

The garment hanger 25, having first and second shoulder members **25*a*, 25*b*, is inverted from its normal hanging position with said first shoulder member 25*a* aligned above and generally parallel with the foremost strip 18*a*. The hanger 25 is arcuately rotated to more precisely align the uppermost point of said first shoulder member 25*a* to which the strip 18*a* is to be applied with the leading edge 19 of said strip 18*a*. See FIG. 5. The first shoulder member 25*a* is engaged with the leading edge 19 of said strip 18*a* thereby resiliently compressing said edge 19. Said shoulder member 25*a* is then drawn toward the user which results in frictional adhesion of said leading edge 19 to said shoulder member 25*a* and thereby lifts the adhesive-backed side of said leading edge 19 from the paper backing 16, curls said edge 19 over, and affixes it to said shoulder member 25*a*. See FIG. 6. Further drawing of the hanger 25 toward the user for the length of the strip 18***a* lifts the entire strip 18*a* off of the paper backing 16 and affixes the entire strip 18*a* to said first shoulder member 25*a*. A gentle rolling of the affixed strip 18*a* over another hard surface insures that the strip 18*a* is firmly affixed to said shoulder member 25*a*. See FIG. 1.

At this point, the guide member 5 is realigned so that it overlays all but the next foremost strip 18*b*. The hanger 25 is rotated to similarly engage the second shoulder member 25*b* with the leading edge 19 of said next foremost strip 18*b*. The aforesaid steps are repeated for this shoulder member 25*b* and strip 18*b* and for each subsequent hanger 25 and strips 18.

As hereinbefore indicated, when all strips 18 have been removed from one side of a folded strip element 15, the strip element 15 is simply inverted to expose the remaining strips 18. All of the foregoing steps are then repeated.

From the foregoing description of the illustrative embodiment for carrying out the method of the present invention it will be apparent that there has been provided a method for simultaneously removing an adhesive-backed, non-slip strip from a backing and applying said strip to the shoulder of a garment hanger which strip facilitates retention of garments hanging thereon. It is intended that the invention not be limited to the particular embodiment disclosed, but that the invention will include all embodiments falling within the scope of the subjoined claims.

The principles of this invention having been fully explained in connection with the foregoing description, I hereby claim as my invention:

1. A method for affixing non-slip strips to the upper edge of the shoulder members of a garment hanger which comprises the steps of supporting a plurality of resilient, adhesive-backed, non-slip strips removably adhered to a backing with a holder, resiliently engaging a shoulder member upper edge with one of said non-slip strips, lifting a leading edge of the strip from said backing with said shoulder member and curling said strip back while drawing said shoulder member upper edge along said strip to simultaneously remove said strip from said backing and affix it to said shoulder member upper edge.

2. The method of claim 1, including, prior to said engagement step, the steps of providing a guide means, placing said guide means over said holder and strips, and aligning said guide means so that one strip is exposed to one side of said guide means.

3. The method of claim 1, including, prior to said engagement step, the steps of providing a holder having a longitudinally extending channel, supporting said strips in said channel, providing a guide means, placing said guide means over said holder and strips, and aligning said guide means so that one strip is exposed to one side of said guide means.

4. A method for affixing non-slip strips to a garment hanger, said hanger comprising two shoulder members each having a top surface, which method comprises the steps of providing a transversely-segmented row of resilient, adhesive-backed, non-slip strips removably adhered to a backing, placing said row, strip side up, onto a holder, placing a guide member over said row and holder, exposing a strip to one side of said guide member, aligning the top surface of a shoulder member with said strip, pressing said shoulder member top surface onto said strip, lifting a leading edge of the strip from said backing with said shoulder member, and curling said strip back while drawing said shoulder member surface across said strip to simultaneously separate said strip from said backing and affix it to said shoulder member.

5. The method as claimed in claim 4 wherein said providing step comprises providing a row of said strips, said row being further segmented longitudinally so that said row can be folded in half with said backing to the inside of the fold.

6. A method for affixing non-slip strips to a garment hanger, which method comprises the steps of providing a holder and cooperating guide means, said holder having a longitudinally extending channel, providing a strip element comprising a layer of resilient, adhesive-backed, non-slip material transversely segmented into strips and removably adhered to a backing, placing said strip element into said holder channel with said non-slip layer facing up, placing said guide means over said holder and strips, aligning said guide means so that one strip is exposed to one side of said guide means, engaging the upper surface of a shoulder member of said garment hanger with a leading edge of said strip, lifting said leading edge from said backing with said shoulder member and curling said strip back with said shoulder member to simultaneously remove said strip from said paper backing and affix it to said shoulder member.

7. The method of claim 6 wherein said strip element providing step comprises providing a strip element segmented longitudinally so that said backing can be folded in half with said backing to the inside of the fold.

* * * * *